US005609493A

United States Patent [19]

Cheng et al.

[11] Patent Number: 5,609,493

[45] Date of Patent: Mar. 11, 1997

[54] DEVICE FOR SHORT-CIRCUITING FOR USE WITH CONNECTOR

[75] Inventors: Lee-Ming Cheng, Cupertino; Conrad Choy, San Francisco, both of Calif.; George Lee, Taipei, Taiwan

[73] Assignee: Hon Hai Precision Ind. Co., Ltd., Taiwan

[21] Appl. No.: 405,236

[22] Filed: Mar. 16, 1995

[51] Int. Cl.[6] ..... H01R 13/635; H01R 31/08

[52] U.S. Cl. ..... 439/157; 439/378; 439/509

[58] Field of Search ..... 439/507–514, 439/157, 160, 378

[56] References Cited

U.S. PATENT DOCUMENTS

| | | | |
|---|---|---|---|
| 4,602,834 | 7/1986 | Hahn et al. | 439/510 |
| 4,607,899 | 8/1986 | Romine et al. | 439/512 |
| 4,659,158 | 4/1987 | Sakamoto et al. | 439/507 |
| 4,997,390 | 3/1991 | Scholz et al. | 439/509 |
| 5,000,699 | 3/1991 | Nadin | 439/507 |
| 5,445,528 | 8/1995 | Frantz | 439/79 |
| 5,462,453 | 10/1995 | Muller | 439/510 |
| 5,468,156 | 11/1995 | Flinchbaugh et al. | 439/157 |

*Primary Examiner*—Neil Abrams

[57] ABSTRACT

A shorting block (10) for use with a header connector (51), includes an insulative housing (12) having a plurality of cavities (14) therein for receipt of the corresponding pin contacts (64) of the header connector (51). A conductive bar (40) attached to the housing (12), has a plurality of arms (44) extending therefrom and adapted to respectively projecting into the corresponding cavities (14) in the housing (12) for respective mechanical and electrical engagement with the pin contacts (64), of the connector (51), received within the cavities (14) of the housing (12) so that pin contacts (64) of the connector (51) engaging the arms (44) of the conductive bar (40) are designedly electrically connected in a form of closed circuit for compliance with the whole operative circuitry. An optional cover (30) is detachably assembled onto the housing (12) for shielding the conductive bar (40) therein.

14 Claims, 17 Drawing Sheets

DEVICE FOR SHORT-CIRCUITING FOR USE WITH CONNECTOR

BACKGROUND OF THE INVENTION

1. Field of The Invention

The invention relates to a device for use with an electrical connector which includes a plurality of contacts for signal transmission, particular to an assembly for short-circuiting some of the corresponding contacts of the connector when no specific electrical module is installed in the connector.

2. The Prior Art

There is no exact prior arts in the invention. The request of the invention is initiated from a new device called Voltage Regulator Module (VRM) which is intended to be introduced in the mother board of a personal computer in the future generation. Such a Voltage Regulator Module can be installed into the computer to meet the voltage requirement of a newly installed advanced chip which replaces, for upgrading, the old one originally loaded in the computer. In other words, the VRM is the required component for upgrading the computer. To provide the present computer with this upgrading capability, As shown in FIGS. 1(A)–1(C), a header connector 51 is designedly disposed on the mother board in the computer for electrical and mechanical receipt of the VRM 53 therein so as to cooperate with an advanced chip mounted on the mother board. In detail and in fact, the VRM 53 includes a socket connector 54, which is substantially mounted on the bottom edge portion of the module board 55 of the VRM 53, for connection to the header connector 51.

Attention is paid to a potential problem that the pin contacts 64 of the header connector 51 are in an open status when the lower level chip is used in the computer does not require a VRM for adjustment or compliance thereof and no such a VRM is installed in the header connector 51. In that situation, the circuits of the whole computer can not function properly. Therefore, the device of the invention called shorting block is suggested to compensate this shortcoming. The shorting block can be attached onto the header connector 51 for intentionally short-circuiting some of contacts of the header connector 51 so that the whole circuitry system is in a close status for its normal function.

Therefore, an object of the invention is to provide a shorting device for use with a header connector which is adapted to receive therein a VRM wherein the shorting device is not only easily loaded into and removed from the corresponding header connector, but also adapted to be reliably retained therein for normal use.

Another object of the invention is to provide a shorting device comprised of less components which are easily manufactured and assembled and the whole assembly cooperates with the corresponding header connector to achieve an efficient and veiled electrical connection therebetween.

SUMMARY OF THE INVENTION

According to an aspect of the invention, a shorting block for use with a header connector, includes an insulative housing having a plurality of cavities therein for receipt of the corresponding pin contacts of the header connector. A conductive bar attached to the housing, has a plurality of arms extending therefrom and adapted to respectively project into the corresponding cavities in the housing for respective mechanical and electrical engagement with the pin contacts, of the connector, received within the cavities of the housing, so that pin contacts of the connector engaging the arms of the conductive bar are designedly electrically connected in a form of closed circuit for compliance with the whole operative circuitry. An optional cover is detachably assembled onto the housing for shielding the conductive bar therein so that there is no chance to inadvertently from an exterior touch the conductive bar that may jeopardize the signal transmission in the whole circuitry.

The shoring block may further optionally include a pair of locking walls integrally extending from the housing to cooperate with a pair of latching ejectors positioned adjacent two opposite ends of the header connector for releasably latching the shorting block in the header connector wherein a pair of funnels positioned at two opposite ends of the housing may receive the corresponding guiding posts of the header connector, respective, for easy insertion and proper assurance of the mutual engagement between the shorting block and the header connector.

DETAILED DESCRIPTION OF THE PREFERRED EMBODIMENT

References will now be made in detail to the preferred embodiments of the invention. While the present invention has been described with reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

Figure 1A:
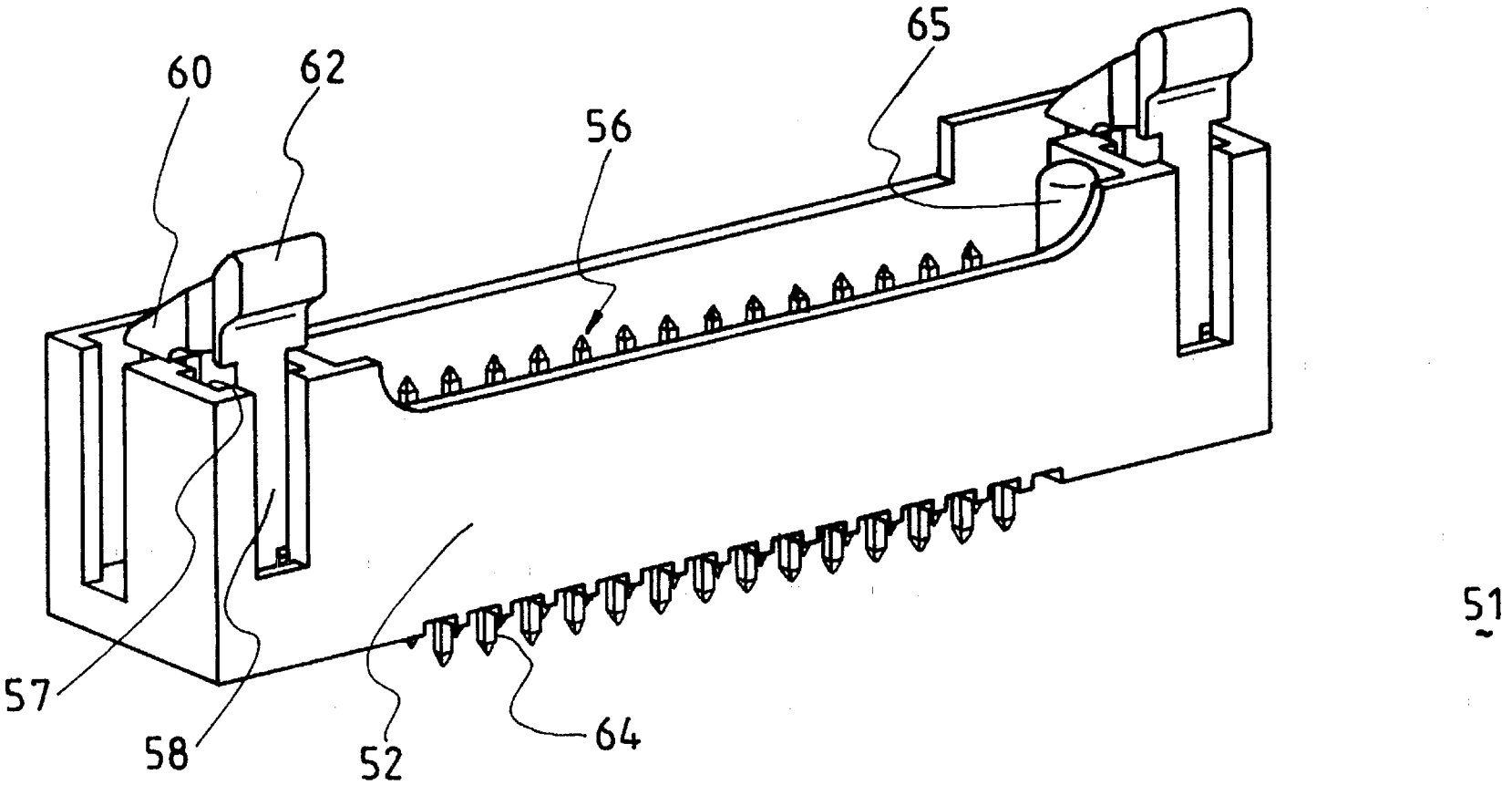
FIG. 1(A) (PRIOR ART)
FIG. 1(A) is a perspective view of a header connector for use with a VRM.

It will be noted here that for a better understanding, most of like components are designated by like reference numerals throughout the various figures in the embodiments. Attention is now directed to FIGS. 2(A)–2(D) wherein a shorting block 10 includes an elongated insulative housing 12 having two rows of cavities 14 extending vertically therethrough for receiving corresponding pin contacts of the header connector 51 as shown in FIG. 1(A) illustrated later. Each cavity 14 comprises a slot 16 along and adjacent the side wall 18. A pair of semicircular funnels 20 are positioned at two opposite ends of the housing 12. A pair of apertures 13 are positioned within the housing 12 adjacent and inside the pair of semicircular funnels 20.

A board 22 is integrally positioned aside the housing 12 wherein the board 22 is substantially longer than the housing 12 in the lengthwise direction so that a pair of locking walls 24 are formed laterally extending with regard to the housing 12. The board 22 also is taller than the housing 12 in the vertical direction for coplanarity with the top surface of a cover 30 which is attached onto the top of the housing 12. The board 22 includes a pair of vertical channels 26 and a pair of locking embossments 28 therein for latching the cover 30 to the housing 12.

The cover 30 includes an elongated insulative base 32 from which a pair of alignment pegs 34 extending downward adjacent two opposite ends thereof, and a pair of latching tabs 36 extending downward from its backside. A pair of semicircular notches 38 are positioned at two opposite ends of the base 32 for conformance with the semicircular funnels 20 in the housing 12. A shallow recess 39 extends upward into the base 32 from the undersurface 33 of the base 32 wherein a pair of protrusions 35 extend downward in the recess 39.

A conductive bar 40 directly formed from a metal strip, includes a strap section 42 having a series of equally spaced holes 43 therein, and two rows of arms 44 integrally extending downward from and along two side edges 46 of the strap section 42 wherein each arm 44 includes an upper wide vertical retention section 48 and a lower narrow curved section 50. The retention section 46 of some arms 44 include barbs 45 for retention within the corresponding cavities 14 of the housing 12 in an interference fit.

Figure 2A:
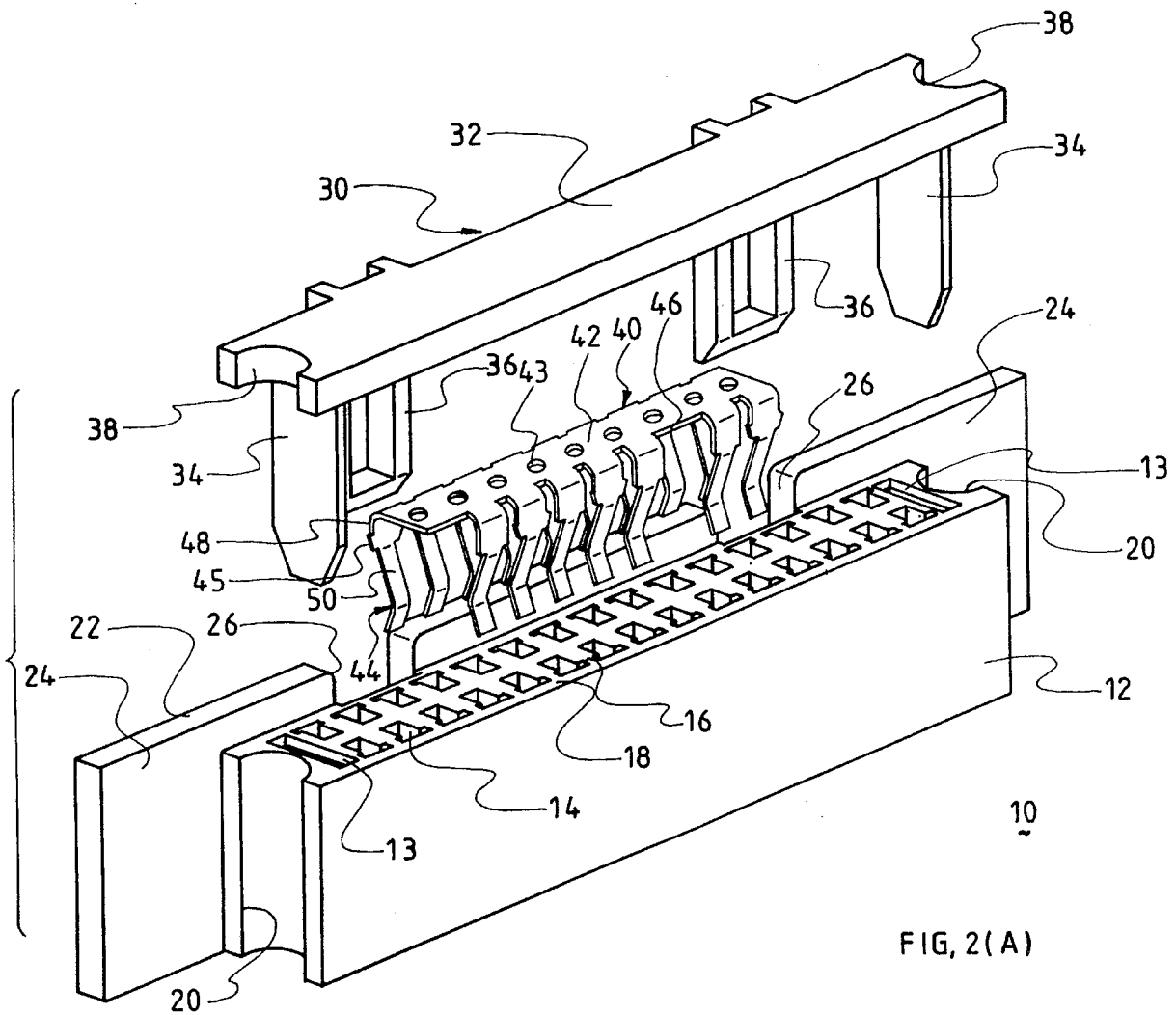
FIG. 2(A) is an exposed front and top perspective view of an embodiment of a shorting block adapted to be use with the header connector of FIG. 1(A) according to the invention.
Figure 2B:
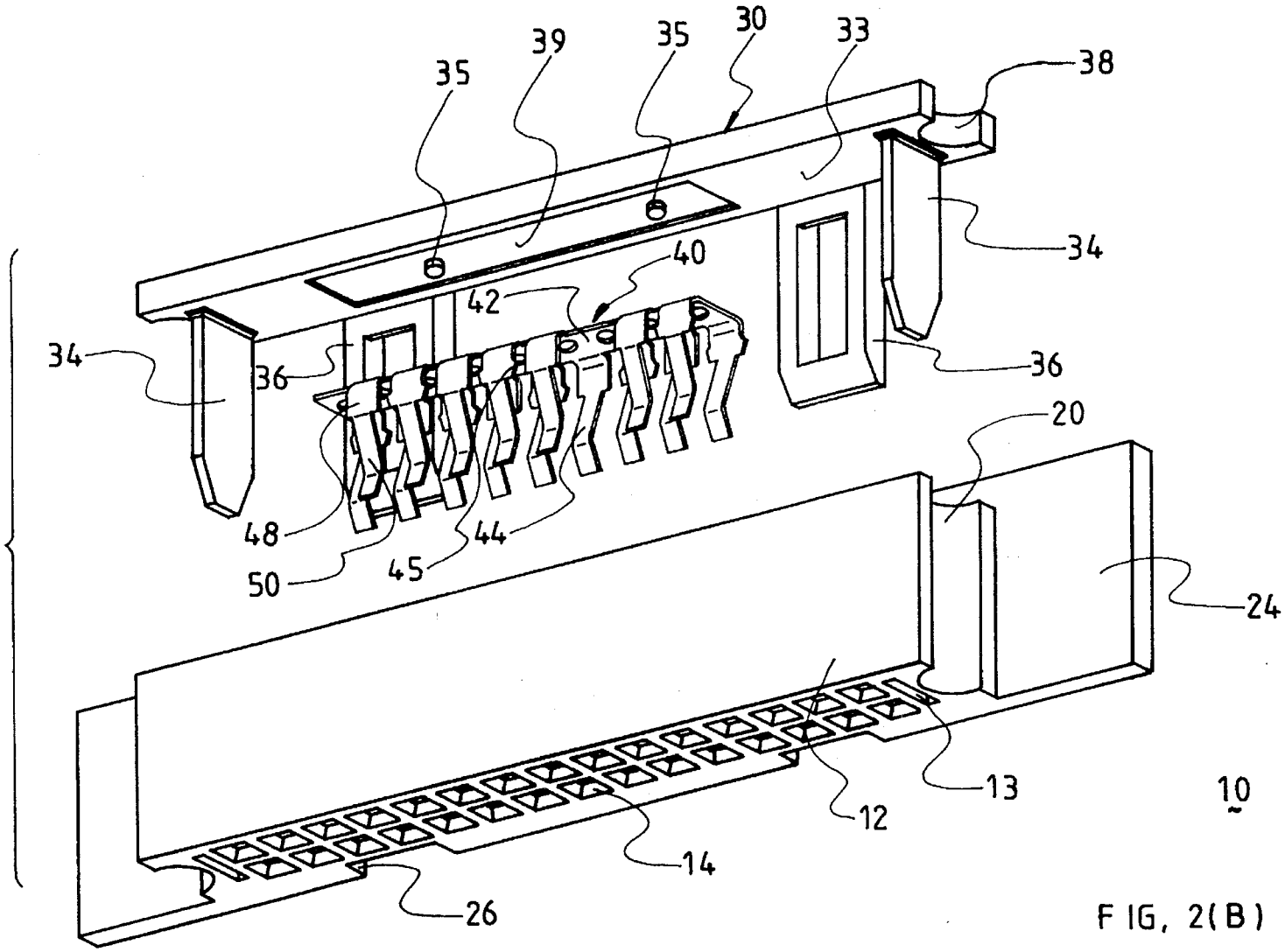
FIG. 2(B) is an exposed front and bottom perspective view of the shorting block of FIG. 2(A) to show the underside structure of the cover and the housing.
Figure 2C:
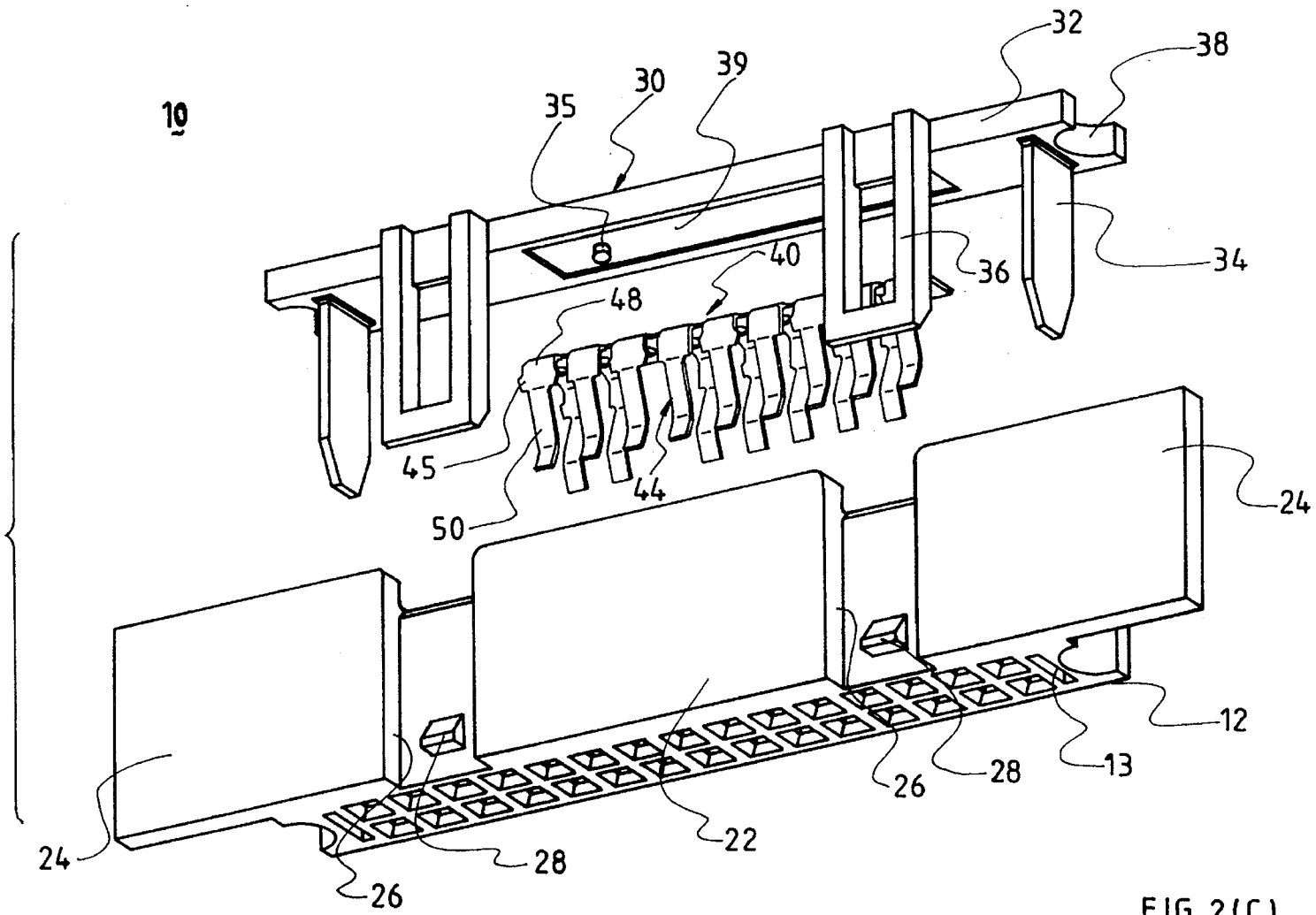
FIG. 2(C) is an exposed back and bottom perspective view of the shorting block of FIG. 2(A) to show the structures latching the cover onto the housing.
Figure 2D:
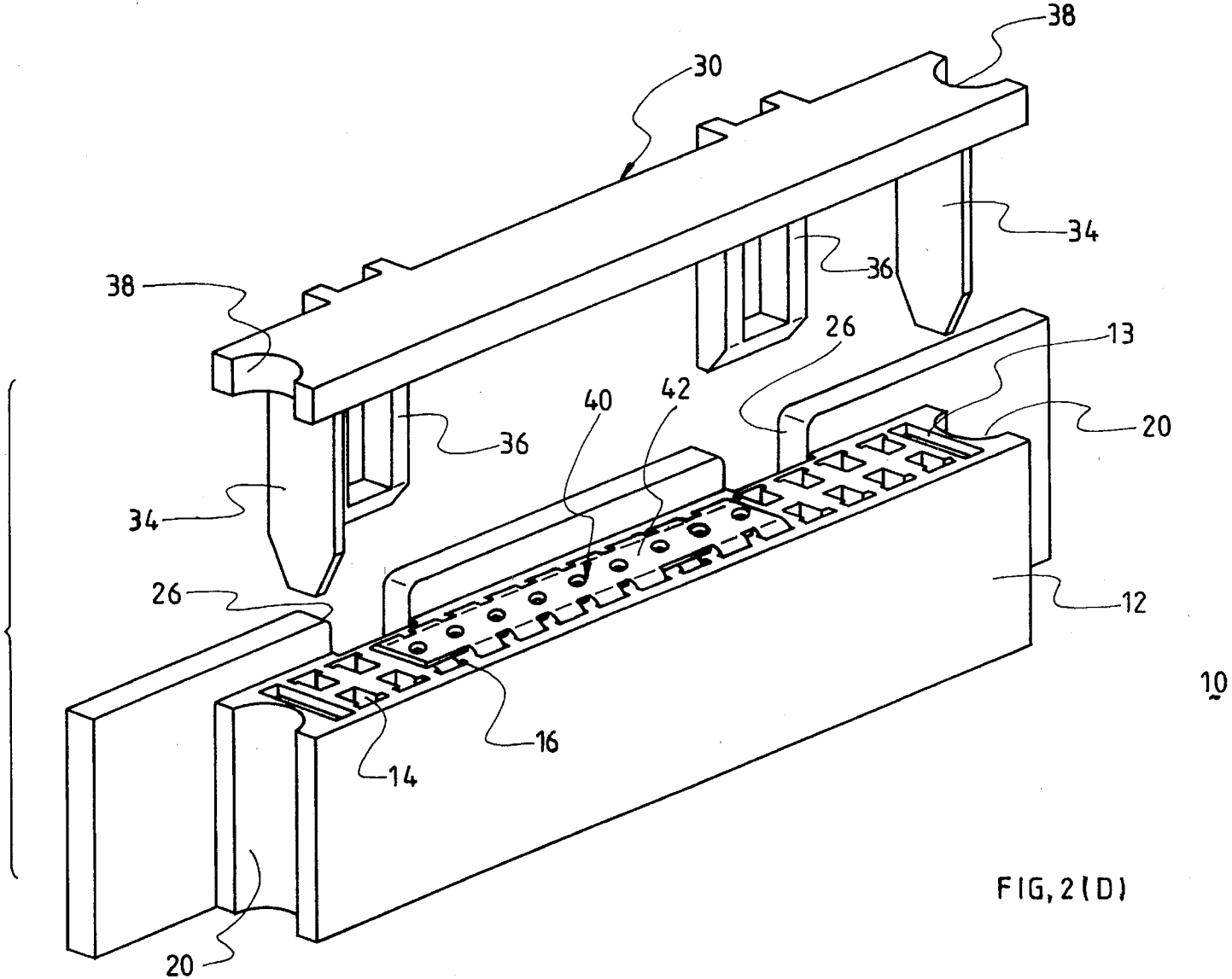
FIG. 2(D) is an exposed front and top perspective view of the shorting block of FIG. 2(A) to show the conductive bar attached onto the housing.

Referring to FIG. 2(D), when assembled, the conductive bar 40 is attached onto the housing 12 from the top so that the arms 44 are inserted into the corresponding cavities 14 wherein the retention section 48 of each arm 44 is received within the slot 16 of in the corresponding cavity 14 and the conductive bar 40 can be retainably attached to the housing 12 by means of barbs 45 of the retention sections 48 of some arms 44 are engaged within the slots 16 of the cavities 14 in an interference fit.

Figure 2E:
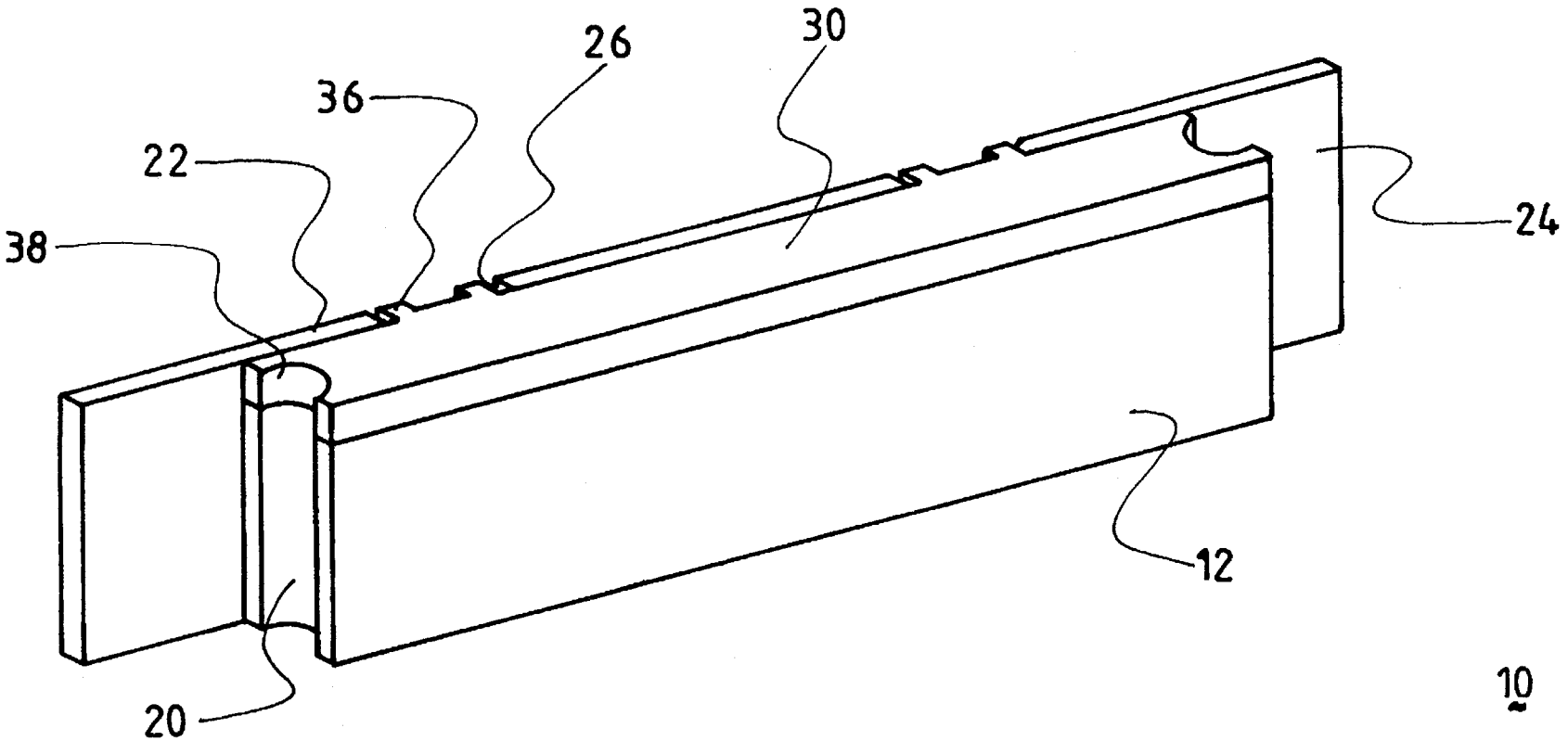
FIG. 2(E) is a front and top perspective view of an assembled shorting block of FIG. 2(A).
Figure 2F:
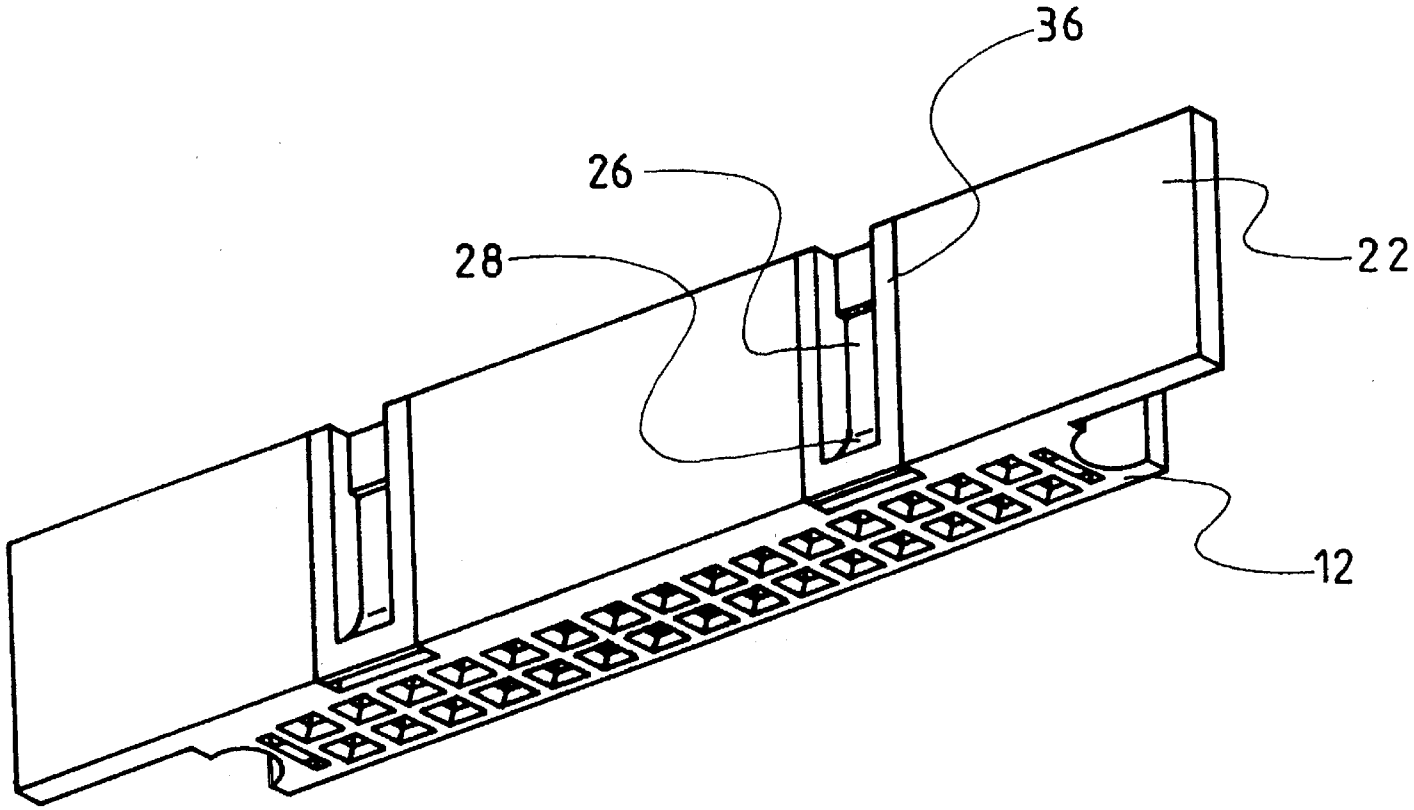
FIG. 2(F) is a back and bottom perspective view of an assembled shorting block of FIG. 2(A).

Successively, As shown in FIGS. 2(E) and 2(F), the cover 30 is loaded onto the housing 12 from the top for sandwiching the conductive bar 40 therebetween. The pegs 34 of the cover 30 are respectively received within the apertures 13 of the housing 12, and latching tabs 36 of the cover 30 are received within the channels 26 in the board and locked by the corresponding embossments 28 therein without withdrawal therefrom.

Figure 3A:
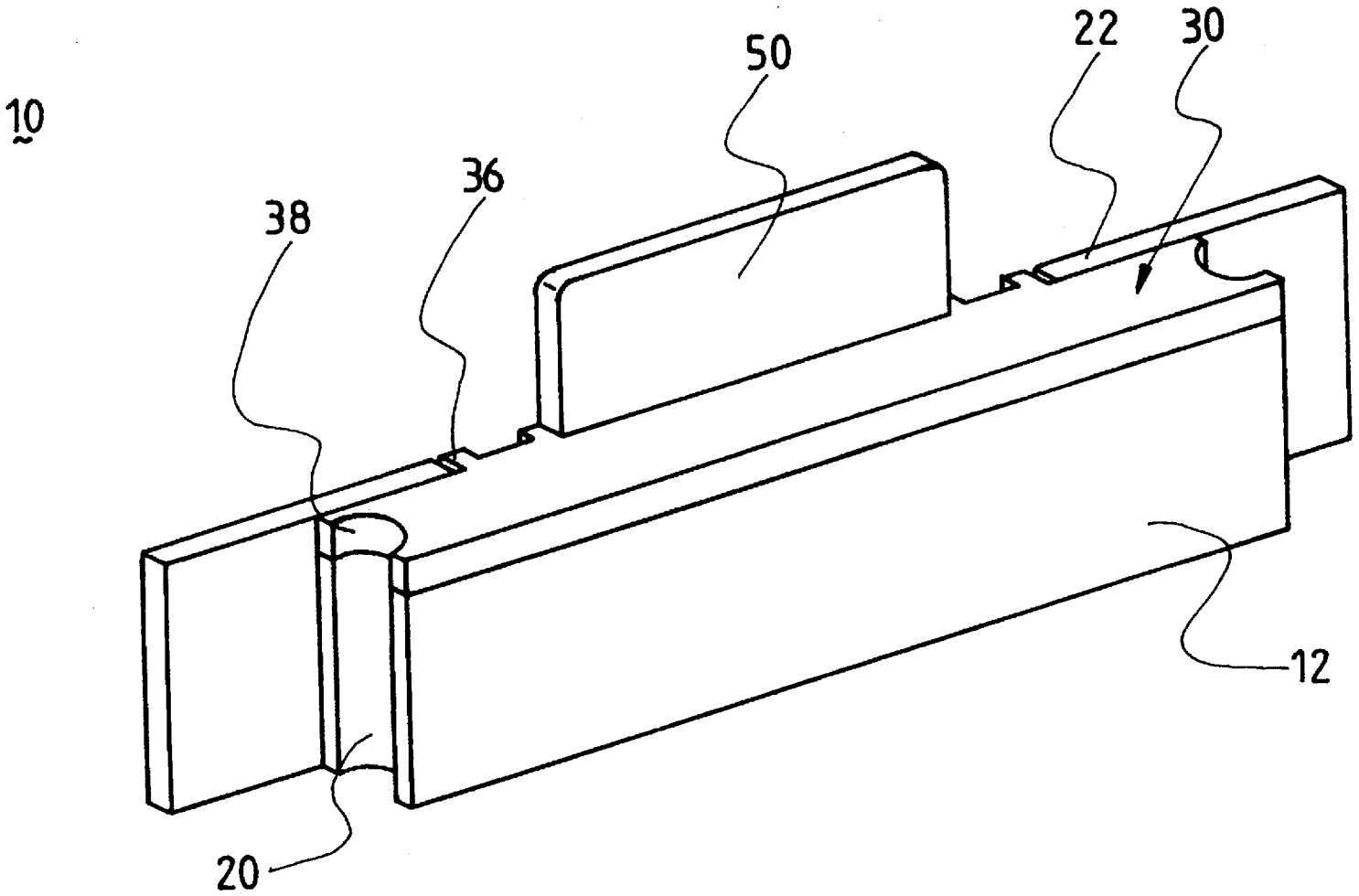
FIG. 3(A) is a front and top perspective view of another embodiment of the shorting block including a upstanding handle for easy operation.
Figure 3B:
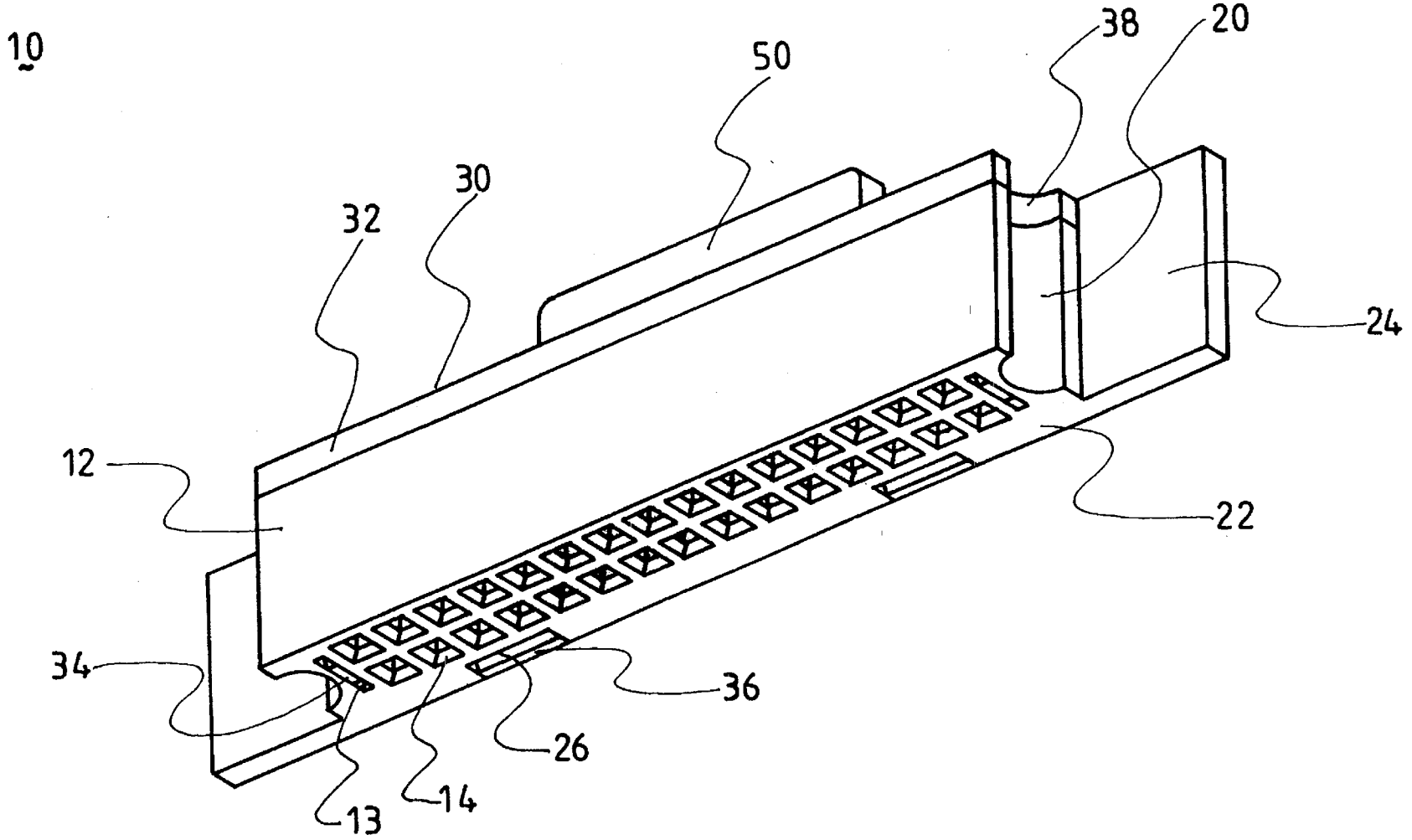
FIG. 3(B) is a back and bottom perspective view of the shorting block of FIG. 3(A).
Figure 4A:
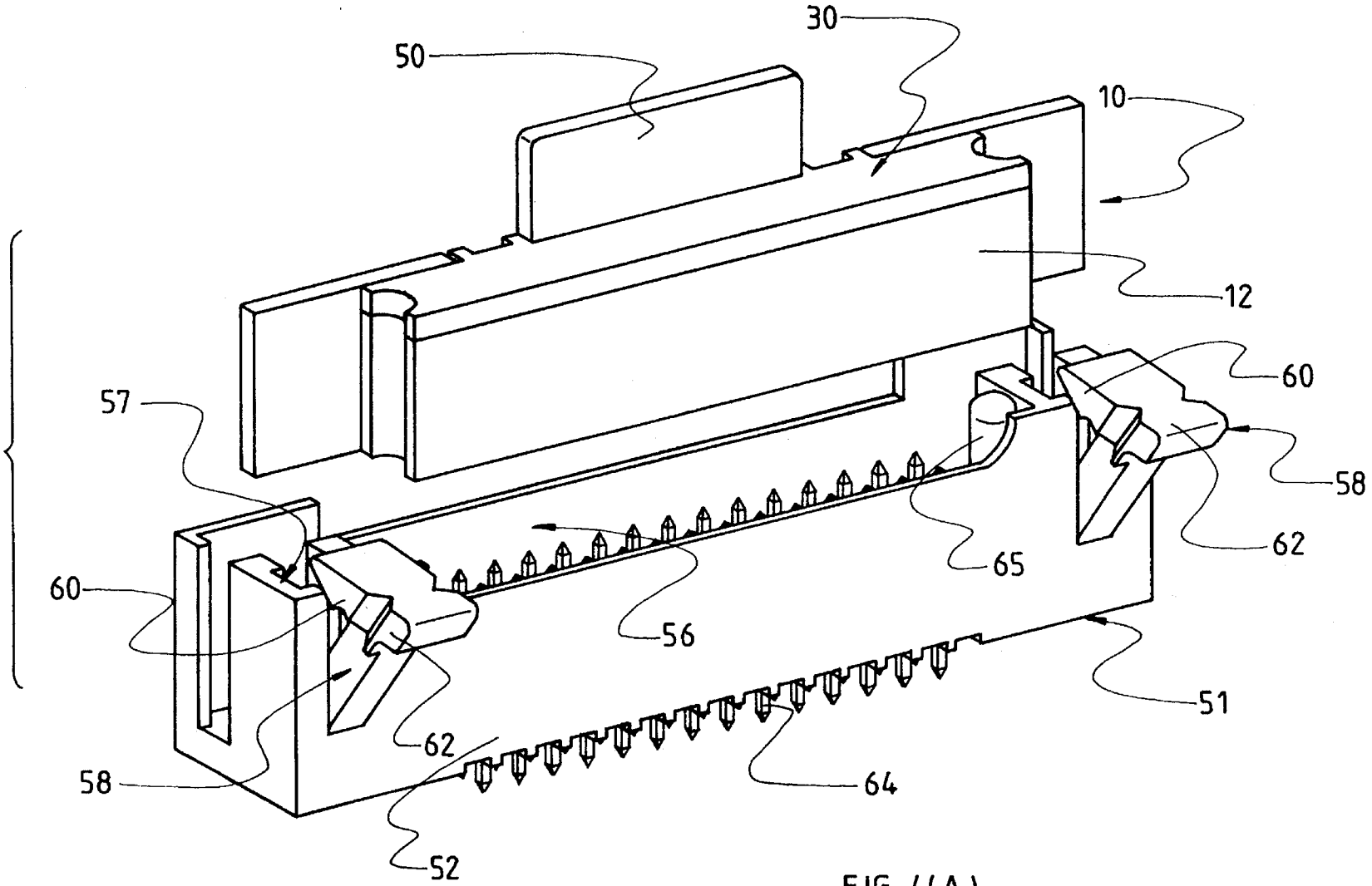
FIG. 4(A) is a perspective view of the shoring block of FIG. 3(A) and the header connector of FIG. 1(A) to show how to insert the shorting block into the header connector.
Figure 4B:
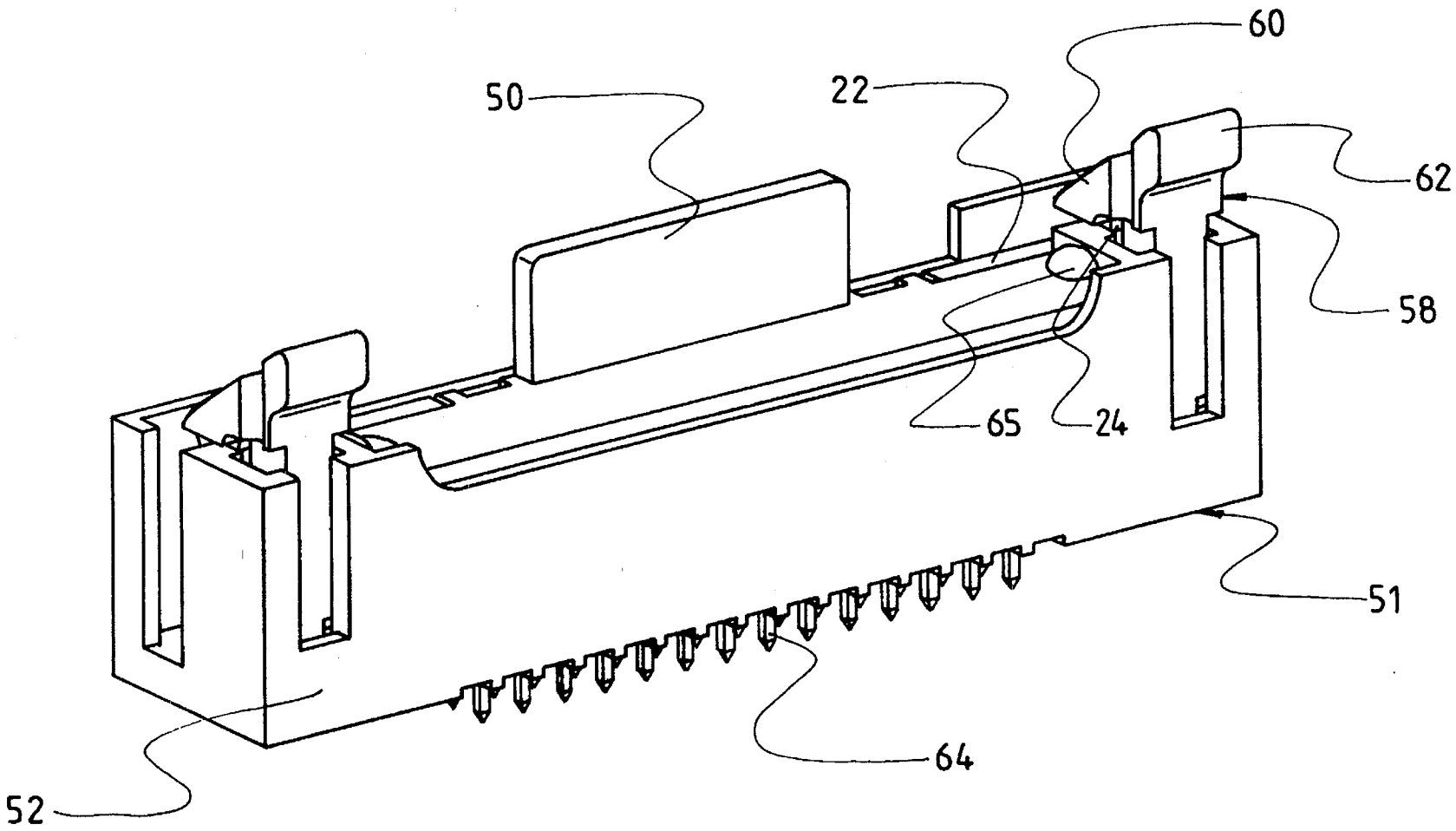
FIG. 4(B) is a perspective view of the shorting block of FIG. 3(A) and the header connector of FIG. 1(A) to show receipt of the shorting block within the header connector.
Figure 4C:
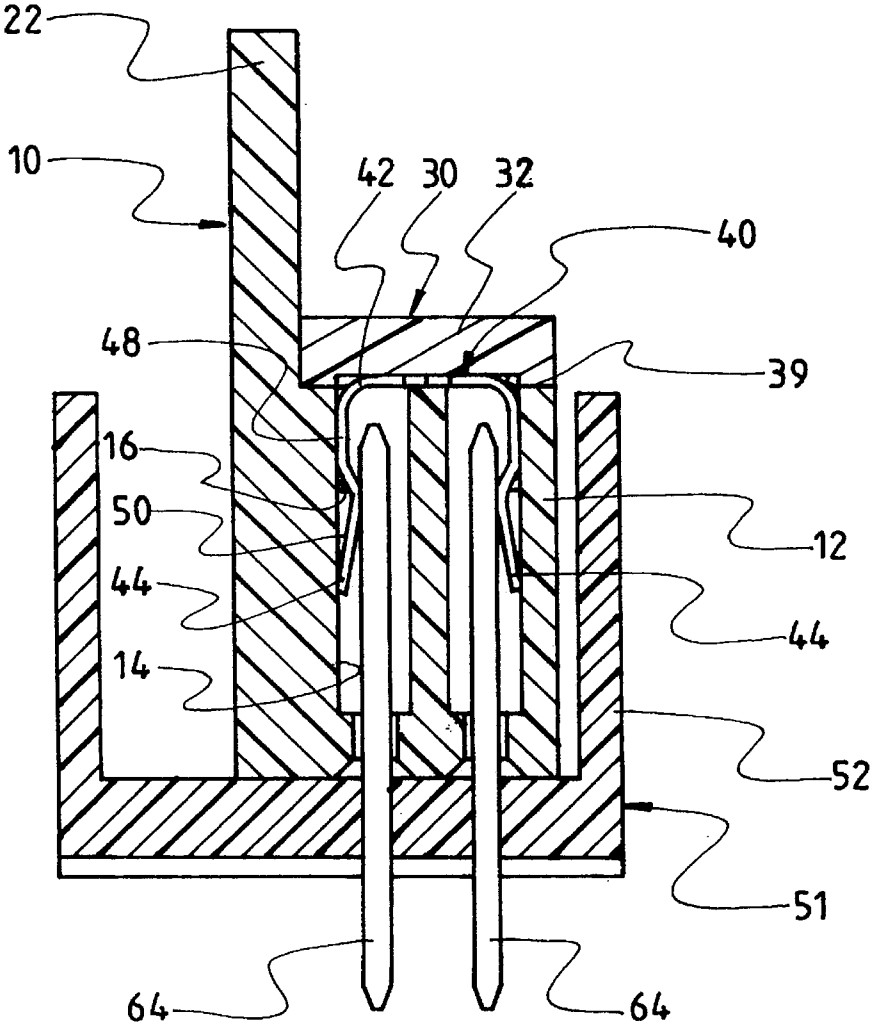
FIG. 4(C) is a cross-sectional view of the shorting block of *FIG. 3(A) and the header connector of FIG. 1(A) without ejectors therein to show the electrical and mechanical engagement between the pin contacts of the header connector and the arms of the conductive bar of the shorting block.

FIGS. 3(A) and 3(B) show another embodiment which further includes a handle 50 upward extending from the top edge of the board 22 so that the whole assembled shorting block 10 can be easily manually held for insertion into the header connector as illustrated in FIGS. 4(A), 4(B) and 4(C). The header connector 51 shown in FIGS. 4(A), 4(B) and 4(C) is exactly same as the header connector 51 shown in FIGS. 1(A)–1(C) which is designedly ready to receive a corresponding VRM 53 therein.

Figure 1B:
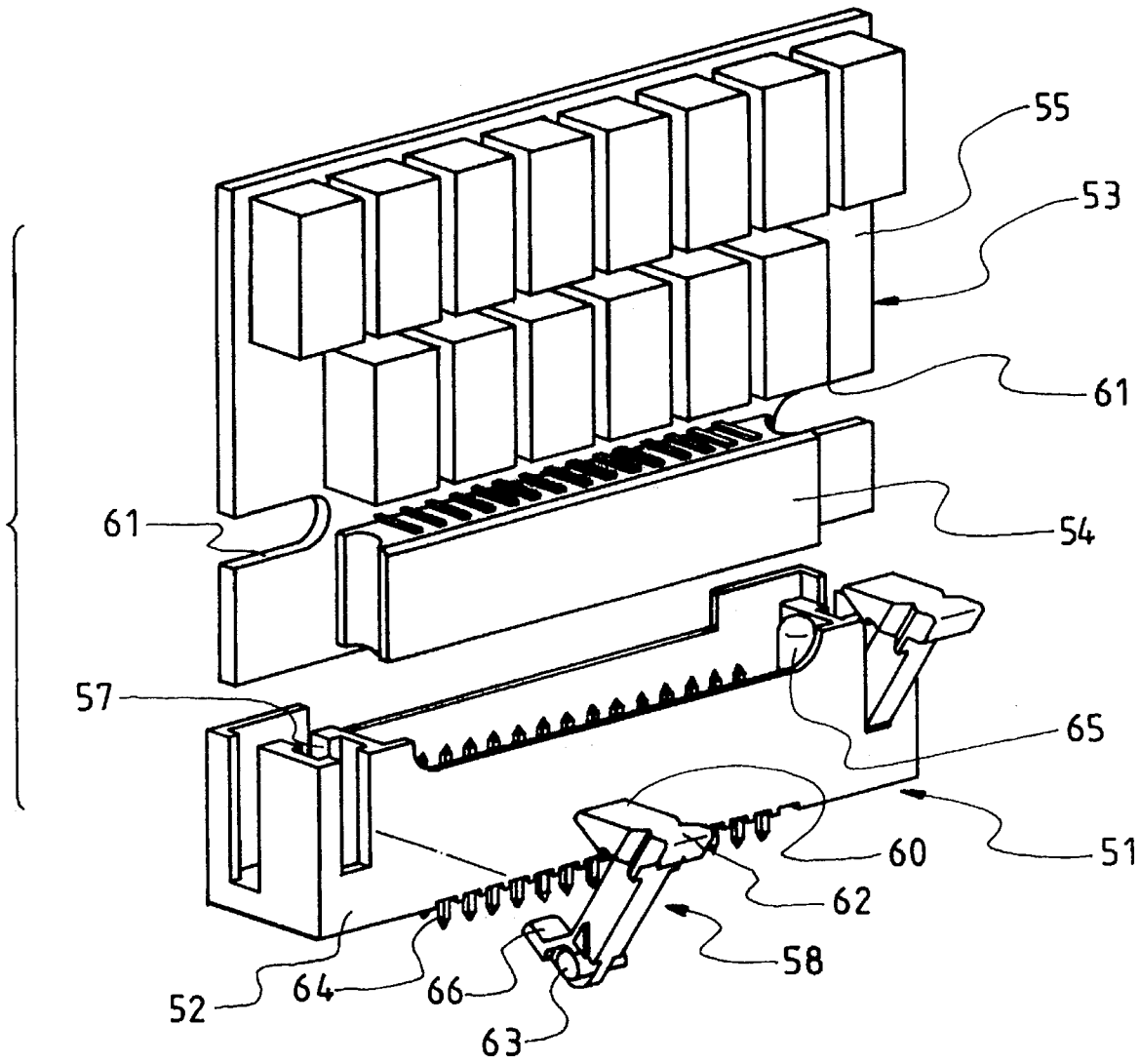
FIG. 1(B) (PRIOR ART)
FIG. 1(B) is a perspective view of a header connector of FIG. 1(A) and a corresponding VRM adapted to be latchably received therein.
Figure 1C:
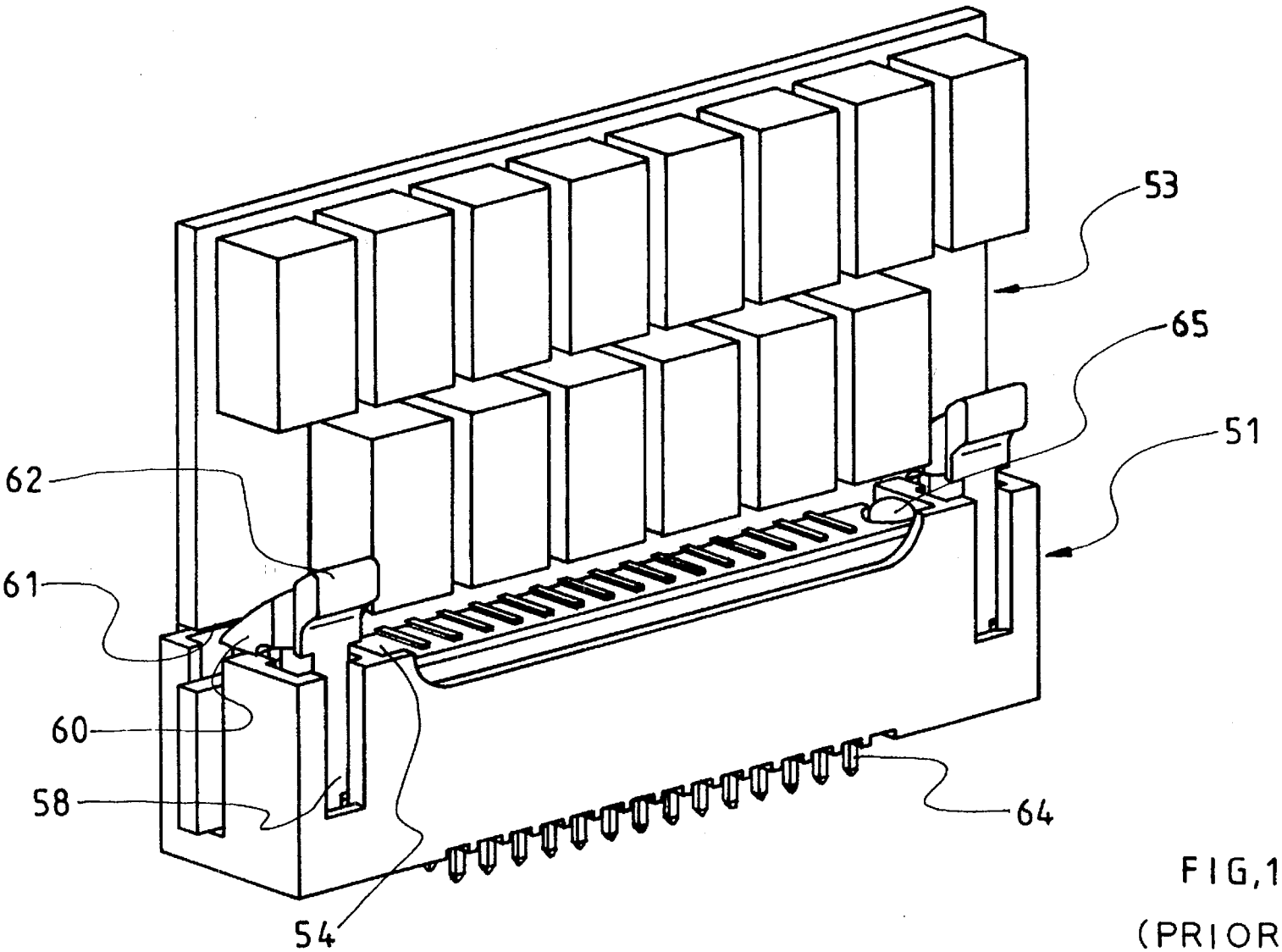
FIG.1(C) (PRIOR ART)
FIG. 1(C) is a perspective view of the header connector of FIG. 1(A) and the corresponding VRM of FIG. 10(B) received therein, and with the separate ejector to show its structure.

The header connector 51 includes an insulative body 52 defining a main space 56 therein for receiving the socket connector 54 of the VRM 53 (FIGS. 1(B) and 1(C)) or the housing 12 of the shorting block 10. A pair of openings 57 are positioned adjacent two opposite ends of the body 52 for respectively receiving a pair of locking ejectors 58 therein. As shown in FIGS. 1(B) and 1(C), each ejector 58 is pivotally positioned within the opening 57 and includes a pushing section 66 at the bottom and a locking section 60 at the top wherein the locking section 60 designedly extends into the notch 61 of the module 55 of the VRM 53 for reliably latching the whole VRM 53 in position when the VRM 53 is embedded within the header connector 51 (FIG. 1(C)), and the pushing section 66 designedly pushes the VRM 53 upward out of the header connector 51 when a force is exerted downward onto the lever 62 to rotate the ejector 58 about its rotation axle 63 thereof for removal of the VRM 53 from the header connector 51. In this rotation, the locking section 60 of the ejector 58 leaves the notch 61 of the VRM 53 and the pushing section 66 butts the bottom edge portion of the board 55 and actuates the VRM 53 to move upward until the socket connector 54 is disengages from the contacts 64 of the header connector 51.

Similar to the VRM 53, the shorting block 10 is also inserted into the header connector 51 from the top under the condition that the ejectors 58 are in a slanted open status for allowance of loading such a shorting block 10 into the header connector 51 from the top. The shorting block 10 continuously downward moves to the header connector 51 by means that the semicircular funnels 20 of the shorting block 10 move along the corresponding guiding posts 65 positioned adjacent two opposite ends of the main space 56. This downward movement continues until the housing 12 is completely embedded within the space 56 and simultaneously the bottom edge portions of the locking walls 24 of the board 22 respectively confront and push down the pushing sections 66 of the ejectors 58. Under this situation, each ejector 58 can be pivotally moved about its axle 63 to a vertical position where the locking section 60 properly sits on the top edge portion of the locking wall 24 of the board 22. Thus, the shorting block 10 can be efficiently retained within the header connector 51. Understandably, similar to the regular VRM, the shorting block 10 can be withdrawn from the header connector 51 by pressing the levers 62 of the ejectors 58 and having such ejectors 58 rotated within the opening 57 in the header connector 51 to have the locking sections 60 leave the locking walls 24 and to have the pushing sections 66 eject the locking walls 24 for releasing the shorting block 10 out of the header connector 51.

As noted, the cavities 14 in the shorting block 10 may respectively receive the corresponding pin contacts 64 of the header connector 51 wherein some of contacts 64 of the header connector 51 may engage the curved sections 50 of the corresponding arms 44 which are already positioned in the same cavities 14 in the shorting block 10. Therefore, the contacts 64 engaging the corresponding arms 44 of the conductive bar 40 are substantially short-circuited with each other, and the circuitry is arranged in a closed status for compliance with the low level chip loaded in the mother board in the computer.

FIG. 4(C) shows each pair of arms 44 which are respectively positioned in two opposite rows but at the same lengthwise position with regard to the strap section 42 of the conductive bar 40, engage the corresponding pair of contacts 64 of the header connector 51, respectively. Understandably, such a pair of arms 44 generate a pair of opposite and complementary normal forces to hold the corresponding pair of contacts 64, thus providing a symmetrical and balanced force along the whole conductive bar 40 of the shorting block 10 and the corresponding contacts 64 of the header connector 51. Moveover, The conductive bar 40 substantially straddles on two rows of cavities 14 of the housing 12, and the strap section 42 covers the top openings of the both two rows corresponding cavities 14, thus resulting in a better shielding for such short-circuited contacts 64. It can be seen that the structure of the conductive bar 40 for use with the header connector 51, provides benefits of easy manufacturing and assembling, and saving material, and better shielding.

Figure 5A:
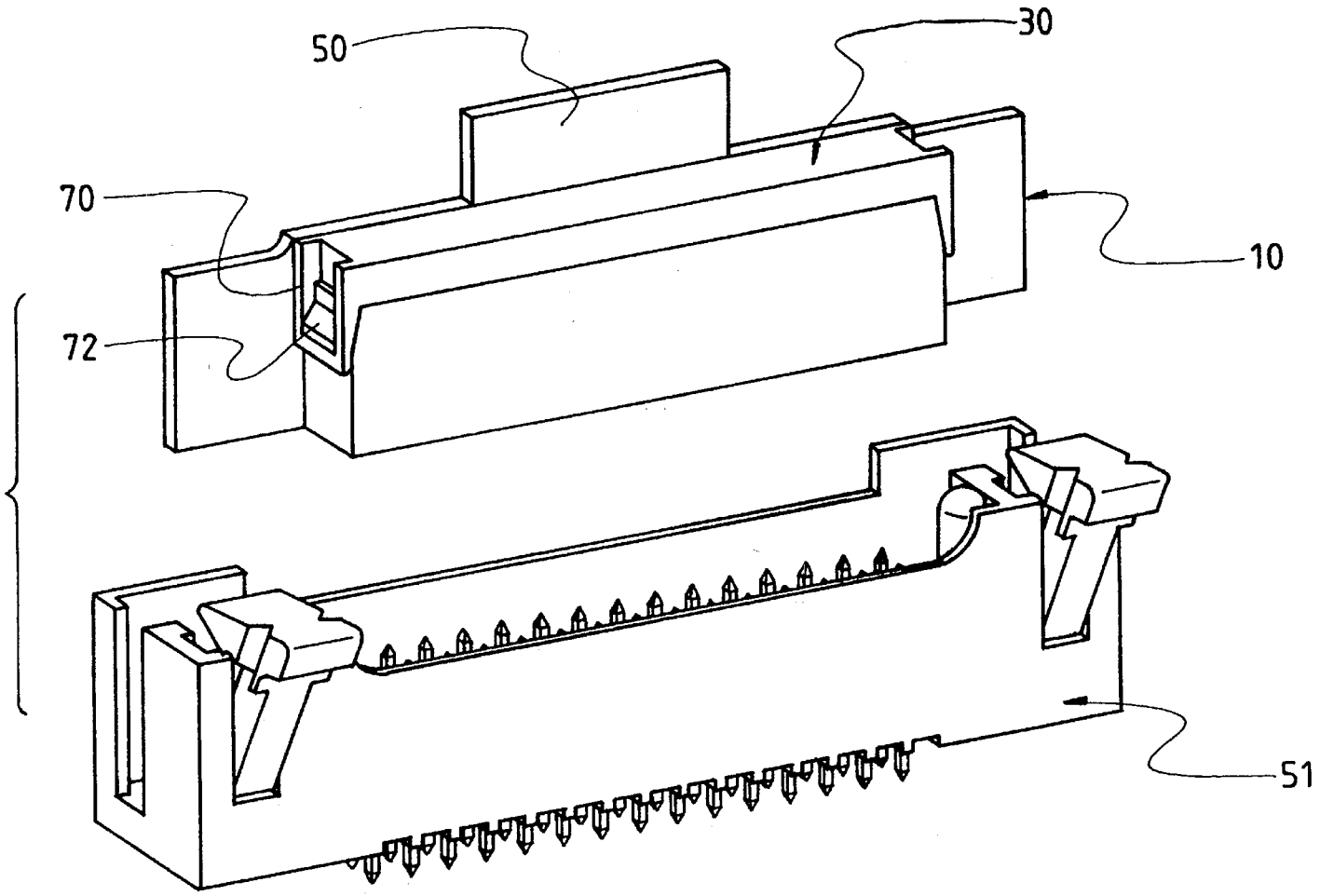
FIG. 5(A) is a front and top perspective view of another embodiment of the shorting block with a header connector of FIG. 1(A) ready to receive the shorting block therein.
Figure 5B:
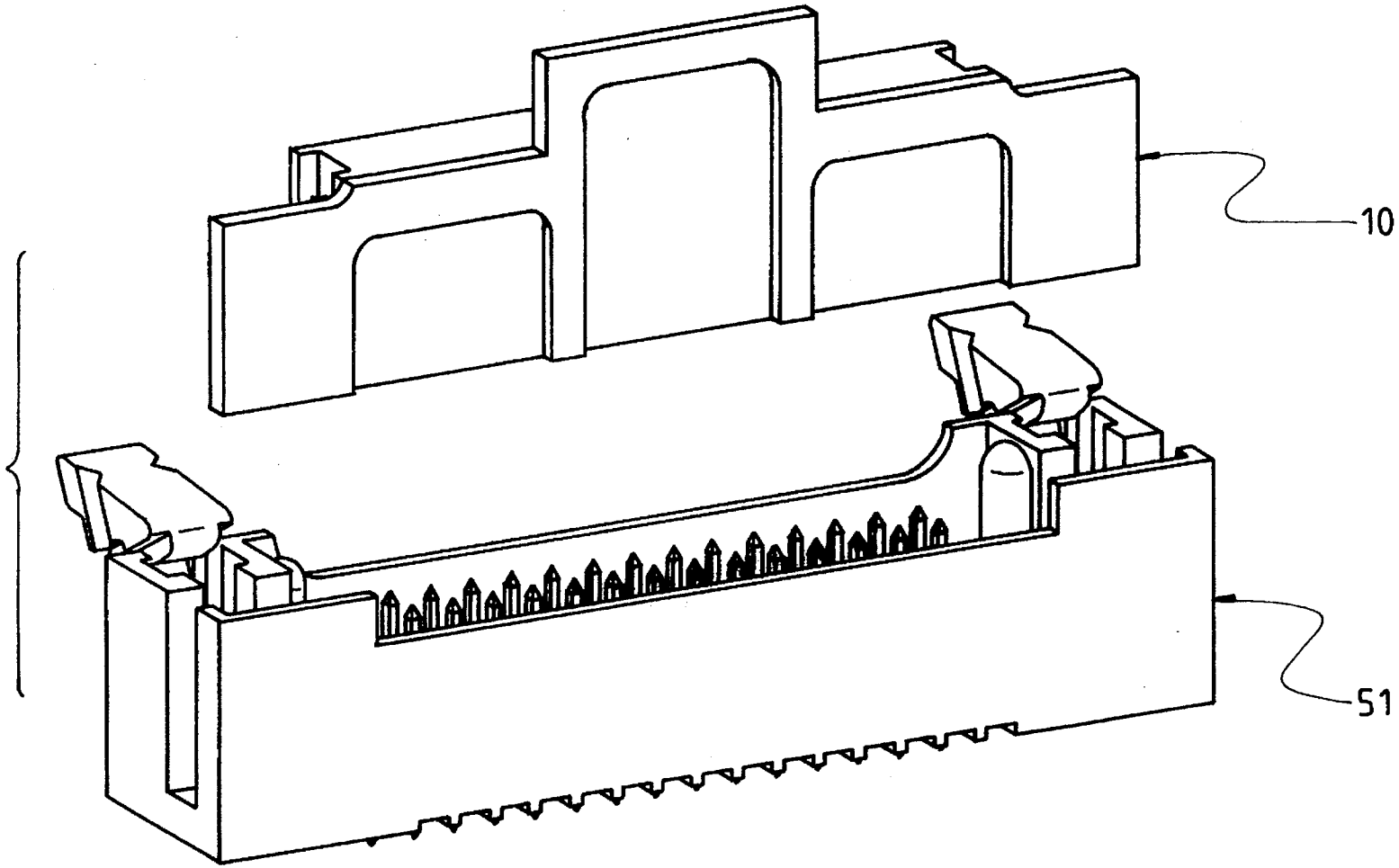
FIG. 5(B) is a back and top perspective view of the shorting block of FIG. 5(A) with the header connector of FIG. 1(A) ready to receive the shorting block therein.
Figure 5C:
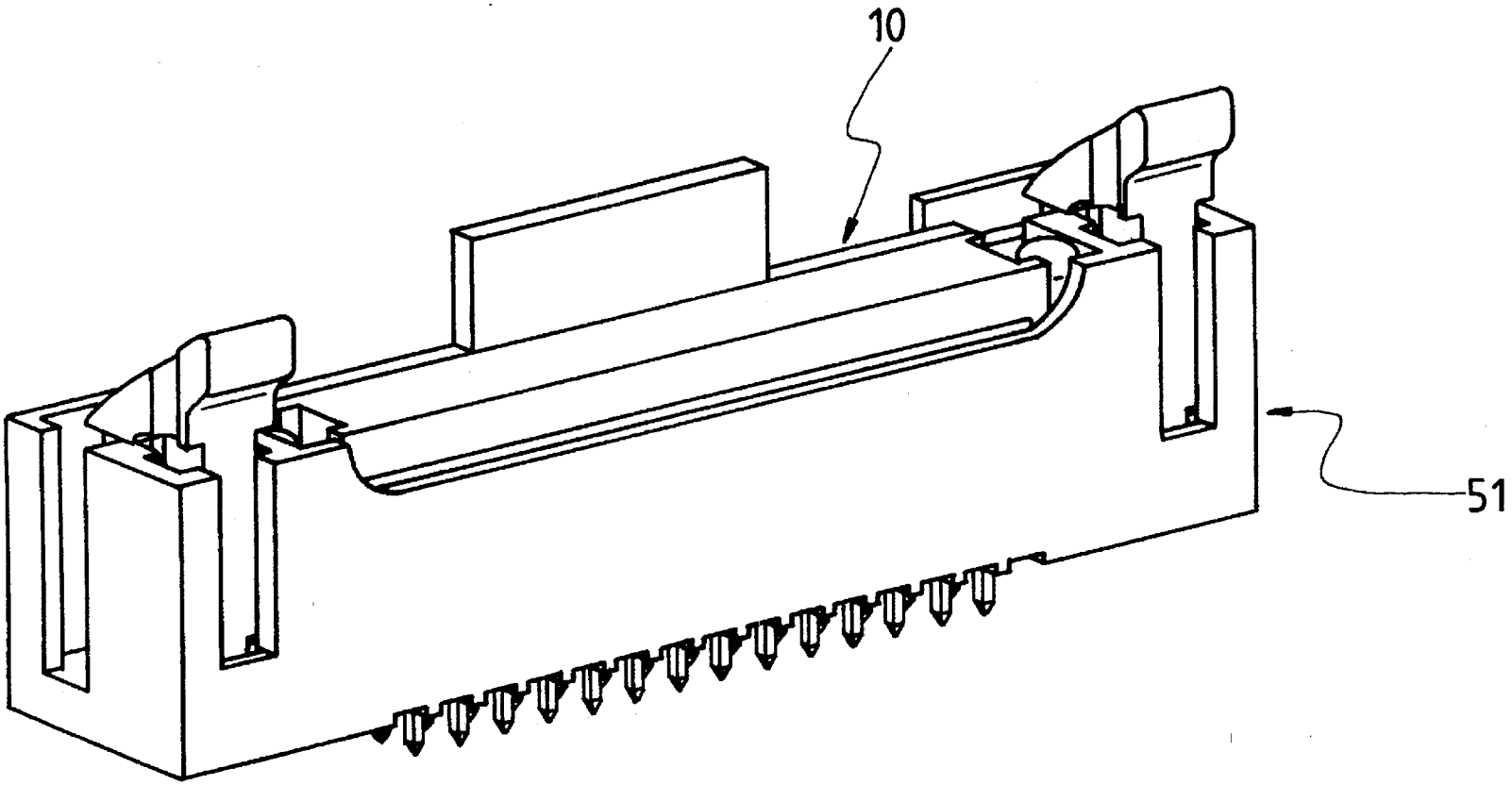
FIG. 5(C) is a front and top view of the shorting block of FIG. 5(A) and the header connector of FIG. 1(A) assembled together.

FIGS. 5(A), 5(B) and 5(C) show another embodiment of the invention wherein the semi-circular funnels 20 of the housing 12 and the semi-circular notches 38 of the cover 30, which are used in the first embodiment, are omitted therefrom. Also, the alignment peg 34 and the latching tab 36 of the cover 30 in the first embodiment are combined together to be formed as one unit 70 and positioned at either end of the cover 30. Correspondingly, the housing 12 is provided with a projection 72 at either end to latch such a unit 70 thereto.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

Therefore, persons of ordinary skill in this field are to understand that all such equivalent structures are to be included within the scope of the following claims.

What is claimed is:

1. A shorting block for use with an electrical connector which is originally designed for receiving a VRM in a space of said connector, comprising:

an elongated insulative housing having a plurality of cavities corresponding to contacts of said connector; and a conductive bar including a plurality of arms extending into the corresponding cavities of the housing so that when there is no VRM required and received within the space of said connector, said shorting block can be inserted into the space of said connector to replace said VRM wherein the contacts of the connector can be received within the cavities of the shorting block and some of the contacts of the connector substantially engage the arms of the conductive bar which are already positioned within the corresponding cavities, such that the contacts of the connector engaging the corresponding arms of the conductive bar, may be short-circuited together for forming a closed circuitry for an operative system in a computer; and wherein said shorting block further includes a board integrally extending beside said housing, and said board comprises a pair of locking walls at two opposite ends for cooperation with ejectors of the connectors to latch or release the shorting block within or from the connector.

2. The shorting block as described in claim 1, wherein said conductive bar is substantially retainably attached to housing so that said shorting block itself can be pre-assembled as one piece before said shorting block is inserted into the corresponding connector.

3. The shorting block as described in claim 1, wherein said shorting block further includes a cover for cooperation with the housing to sandwich the conductive bar therebetween for protection and shielding said conductive bar in the shorting block.

4. The shorting block as described in claim 1, wherein said housing further includes a pair of semi-circular funnels for receiving a pair of corresponding semi-circular posts of the connector therein.

5. The shorting block as described in claim 2, wherein said conductive bar comprises an elongated strap section from which said arms downward extend.

6. The shorting block as described in claim 5, wherein each of said arms of the conductive bar has a retention section for retainable receipt within a slot of the corresponding cavity of the housing and a curved section for partially occupying the corresponding cavity of the housing for engagement with the corresponding contact of the header connector.

7. The shorting block as described in claim 3, wherein said cover further includes a pair of alignment pegs and a pair of latching tabs.

8. A shorting block as described in claim 7, wherein said housing further includes a pair of apertures for receiving said pair of alignment pegs, and the board includes a pair of channels for receiving said pair of latching tabs and further includes a pair of embossments in said channels for locking said pair of latching tabs of the cover.

9. The shorting block as described in claim 5, wherein said shorting block further includes a cover having an undersurface recess for receiving the strap section of the conductive bar.

10. The shorting block as described in claim 5, wherein a plurality of holes are formed along said strap section for cooperation with protrusions extending downward from an undersurface of the cover to hold said conductive bar in position.

11. An electrical assembly for use with a VRM design, comprising:

a header connector including an insulative body having a plurality of contacts therein, said connector further including a main space for electrically and mechanically receiving a VRM therein for engagement with said corresponding VRM, and a pair of openings positioned at two opposite ends for receiving a pair of latching ejectors therein so that said VRM can be locked with or ejected from said connector through said pair of ejectors; and a shorting device adapted to be received within the main space of the connector, said shorting device including a housing and at least further including a conductive bar integrally having a plurality of engagement means for respective electrical and mechanical engagement with some of the contacts of the connector for designedly short-circuiting said some contacts when no VRM is loaded within said connector; wherein said shorting block further includes a board integrally extending from and beside said housing, and said board comprises at least a locking wall at one end for cooperation with ejectors of the connector to lock or release said shorting block with regard to the connector.

12. The assembly as described in claim 11, wherein said housing retainably holds said conductive bar therein.

13. The assembly as described in claim 12, wherein said housing further includes a plurality of cavities for respectively receiving the contacts of the connector, correspondingly.

14. A shorting block (10) for use with a header connector (51) which includes an insulative body (52) having a plurality of contacts (64) therein, said connector (51) further including a main space (56) for electrically and mechanically receiving a VRM (53) therein for engagement with said corresponding VRM (53), and a pair of openings (57) positioned at two opposite ends for receiving a pair of latching ejectors (58) therein so that said VRM (53) can be locked with or ejected from said connector (51) through said pair of ejector (58); said shorting block (10) being adapted to be received within the main space (56) of the connector (51), and comprising:

at least a conductive bar (40) having a plurality of arms (44) extending downward into the main space (56) of the connector (51) for mechanical and electrical engagement with some selected contacts (64) of the connector (51); and a board (22) including at least an integrally extending locking wall (24) to be positioned adjacent one of the openings (57) in the connector (51) for cooperation with said corresponding ejector (58) of the connector (51) to lock or release said shorting block (10) with regard to the connector (51) wherein the board (22) further includes a handle (50) extending from edge of the board (22) so that the whole assembled shorting block (10) can be easily manually held for insertion into the header connector (51).

* * * * *